US008823446B2

(12) United States Patent
Shiah et al.

(10) Patent No.: US 8,823,446 B2
(45) Date of Patent: Sep. 2, 2014

(54) CURRENT MIRROR WITH IMMUNITY FOR THE VARIATION OF THRESHOLD VOLTAGE AND THE GENERATION METHOD THEREOF

(75) Inventors: Chun Shiah, Hsinchu (TW); Hao-Jan Yang, Yunlin County (TW); Ho-Yin Chen, Hsinchu County (TW); Kuo-Chen Lai, Changhua County (TW)

(73) Assignee: Etron Technology, Inc., Hsinchu (TW)

( * ) Notice: Subject to any disclaimer, the term of this patent is extended or adjusted under 35 U.S.C. 154(b) by 951 days.

(21) Appl. No.: 12/471,403

(22) Filed: May 24, 2009

(65) Prior Publication Data

US 2010/0052646 A1 Mar. 4, 2010

(30) Foreign Application Priority Data

Aug. 28, 2008 (TW) ..... 97132956 A

(51) Int. Cl.

| | |
|---|---|
| ***G05F 1/10*** | (2006.01) |
| ***G05F 1/56*** | (2006.01) |
| ***G05F 3/26*** | (2006.01) |

(52) U.S. Cl.

CPC ..... *G05F 3/262* (2013.01); *G05F 1/561* (2013.01)

USPC ..... 327/543

(58) Field of Classification Search

USPC ..... 327/72, 73, 77, 78, 80, 81, 87–89, 538, 327/540, 541, 543, 545, 546

See application file for complete search history.

(56) References Cited

U.S. PATENT DOCUMENTS

| | | | | |
|---|---|---|---|---|
| 6,008,632 | A * | 12/1999 | Sasaki | 323/313 |
| 6,624,685 | B2 * | 9/2003 | Shih et al. | 327/541 |
| 7,019,585 | B1 * | 3/2006 | Wilson et al. | 327/541 |
| 7,663,420 | B2 * | 2/2010 | Araki et al. | 327/308 |
| 7,746,163 | B2 * | 6/2010 | Akita | 327/541 |

* cited by examiner

*Primary Examiner* — Sibin Chen

(74) *Attorney, Agent, or Firm* — Winston Hsu; Scott Margo

(57) ABSTRACT

A current mirror with immunity for the variation of threshold voltage includes raising the voltage difference between the gate and the source of a MOS in the current source, and increasing the channel length of the MOS for limiting the generated reference current.

18 Claims, 5 Drawing Sheets

CURRENT MIRROR WITH IMMUNITY FOR THE VARIATION OF THRESHOLD VOLTAGE AND THE GENERATION METHOD THEREOF

BACKGROUND OF THE INVENTION

1. Field of the Invention

The present invention relates to a current source with immunity for the variation of threshold voltage, and more particularly, to a current source for lowering the impact of the threshold voltage on the magnitude of the current, by increasing the voltage difference between the gate and the source of the current source.

2. Description of the Prior Art

Please refer to FIG. 1. FIG. 1 is a diagram illustrating a conventional current mirror. As shown in FIG. 1, the gate (control end) of the P-type Metal Oxide Semiconductor (PMOS) transistor $Q_{P1}$ is utilized to receive a control voltage $V_G$, the source (first end) of the PMOS transistor $Q_{P1}$ is coupled to a voltage source $V_{DD}$, and the drain (second end) of the PMOS transistor $Q_{P1}$ is utilized to output a current $I_1$. The gate (control end) of the PMOS transistor $Q_{P2}$ is utilized to receive the control voltage $V_G$, the source (first end) of the PMOS transistor $Q_{P2}$ is coupled to the voltage source $V_{DD}$, and the drain (second end) of the PMOS transistor $Q_{P2}$ is utilized to output a current $I_2$. The conventional current mirror utilizes the control voltage $V_G$ to bias the PMOS transistor $Q_{P1}$ for generating the reference current source $I_1$, and then the ratio of the channel aspect ratios (width/length, W/L) of the PMOS transistors $Q_{P1}$ and $Q_{P2}$ is utilized to generate the current $I_2$, which is proportional to the reference current source $I_1$. For instance, if the channel aspect ratio ($W_1/L_1$) of the PMOS transistor $Q_{P1}$ is "1" and the channel aspect ratio ($W_2/L_2$) of the PMOS transistor $Q_{P2}$ is "2", then when the reference current source $I_1$ is 1 amp, the current $I_2$ is generated to be 2 amps.

The conventional current mirror operates the PMOS transistor $Q_{P1}$ in the saturation region. In other words, the relationship between the current $I_1$ and the voltage $V_G$ is described in the formulas as below:

$$I_1 = \tfrac{1}{2} \times K \times (W_1/L_1) \times (V_{SG} - V_T)^2 \quad (1);$$

$$= \tfrac{1}{2} \times K \times (W_1/L_1) \times (V_{DD} - V_G - V_T)^2 \quad (2);$$

where the voltage $V_{SG}$ represents the voltage difference, which is equivalent to the voltage of ($V_{DD}-V_G$), between the source and the gate of the PMOS transistor $Q_{P1}$, the voltage $V_T$ represents the threshold voltage of the PMOS transistor $Q_{P1}$, and K represents a process variable. Hence, the magnitude of the reference current source $I_1$ is related to the channel aspect ratio ($W_1/L_1$) of the PMOS transistor $Q_{P1}$, the voltage difference $V_{SG}$ (equivalent to ($V_{DD}-V_G$)), and the threshold voltage $V_T$.

Due to the magnitude of the threshold voltage $V_T$ is easily affected by the processing, when under different processing, the magnitude of the current source $I_1$ is still affected by the threshold voltage $V_T$, even with the same voltage source $V_{DD}$, the same voltage difference $V_{SG}$ between the source and the gate, and the same channel aspect ratio (W/L). In this way, the magnitude of the current source differs from the desired.

SUMMARY OF THE INVENTION

The present invention provides a current source for driving a first Metal Oxide Semiconductor (MOS) transistor to generate a predetermined current. The current source comprises a feedback circuit. The feedback circuit comprises a second MOS transistor, a third MOS transistor, a fourth MOS transistor, a fifth MOS transistor, a first resistor coupled between the ground end and the control end of the fifth MOS transistor, and a MOS circuit. The second MOS transistor comprises a first end coupled to a voltage source, a control end, and a second end coupled to the control end of the second MOS transistor. The third MOS transistor comprises a first end coupled to the voltage source, a control end coupled to the control end of the second MOS transistor, and a second end. The fourth MOS transistor comprises a first end coupled to the second end of the third MOS transistor, a control end for receiving a control voltage, and a second end coupled to a ground end. The fifth MOS transistor comprises a first end coupled to the second end of the second MOS transistor, a control end for outputting the control voltage, and a second end coupled to the ground end. The MOS circuit comprises a first end coupled to the voltage source, a control end coupled to the first end of the fourth MOS transistor, and a second end coupled to the control end of the fifth MOS transistor.

The present invention further provides a current source. The current source comprises a first MOS transistor for generating a predetermined current, a feedback circuit, a first resistor coupled to a ground end and the output end of the feedback circuit, and a MOS circuit. The feedback circuit comprises a first end coupled to a voltage source, a control end for receiving a control voltage, an output end for outputting the control voltage, and a feedback end coupled to a control end of the first MOS transistor. The MOS circuit comprises a first end coupled to the voltage source, a control end coupled to the feedback end of the feedback circuit, and a second end coupled to the output end of the feedback circuit.

The present invention further provides a method for generating current with immunity for variation of threshold voltage. The method comprises providing a first MOS transistor for a first end of the first MOS transistor to be coupled to a voltage source, providing a MOS transistor circuit to be coupled to the first MOS transistor and the voltage source, providing a feedback circuit to be coupled to the voltage source, and inputting a control voltage to the feedback circuit for control a current with a predetermined magnitude passing through the MOS transistor circuit, as well as control a voltage of the feedback end, wherein the feedback end is coupled to a control end of the first MOS transistor. The feedback circuit comprises a feedback end coupled between the MOS transistor circuit and the first MOS transistor.

These and other objectives of the present invention will no doubt become obvious to those of ordinary skill in the art after reading the following detailed description of the preferred embodiment that is illustrated in the various figures and drawings.

DETAILED DESCRIPTION

Hence, the present invention raises the voltage difference $V_{SG}$ between the source and the gate of the MOS transistor for reducing the impact of varying the threshold voltage $V_T$, according to formulas (1) and (2) of the current of the MOS transistor operating in the saturation region. However, to keep the reference current source $I_1$ generating a fixed current without changing the process variable K, the channel aspect ratio (W/L) of the MOS transistor needs to be reduced in order to keep the current of the reference current source $I_1$ in the same range.

Figure 1:
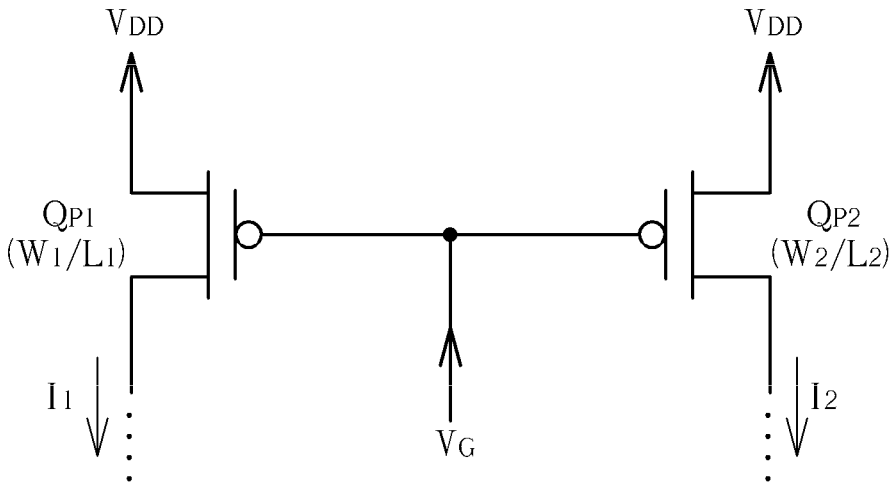
FIG. 1 PRIOR ART
FIG. 1 is a diagram illustrating a conventional current mirror.
Figure 2:
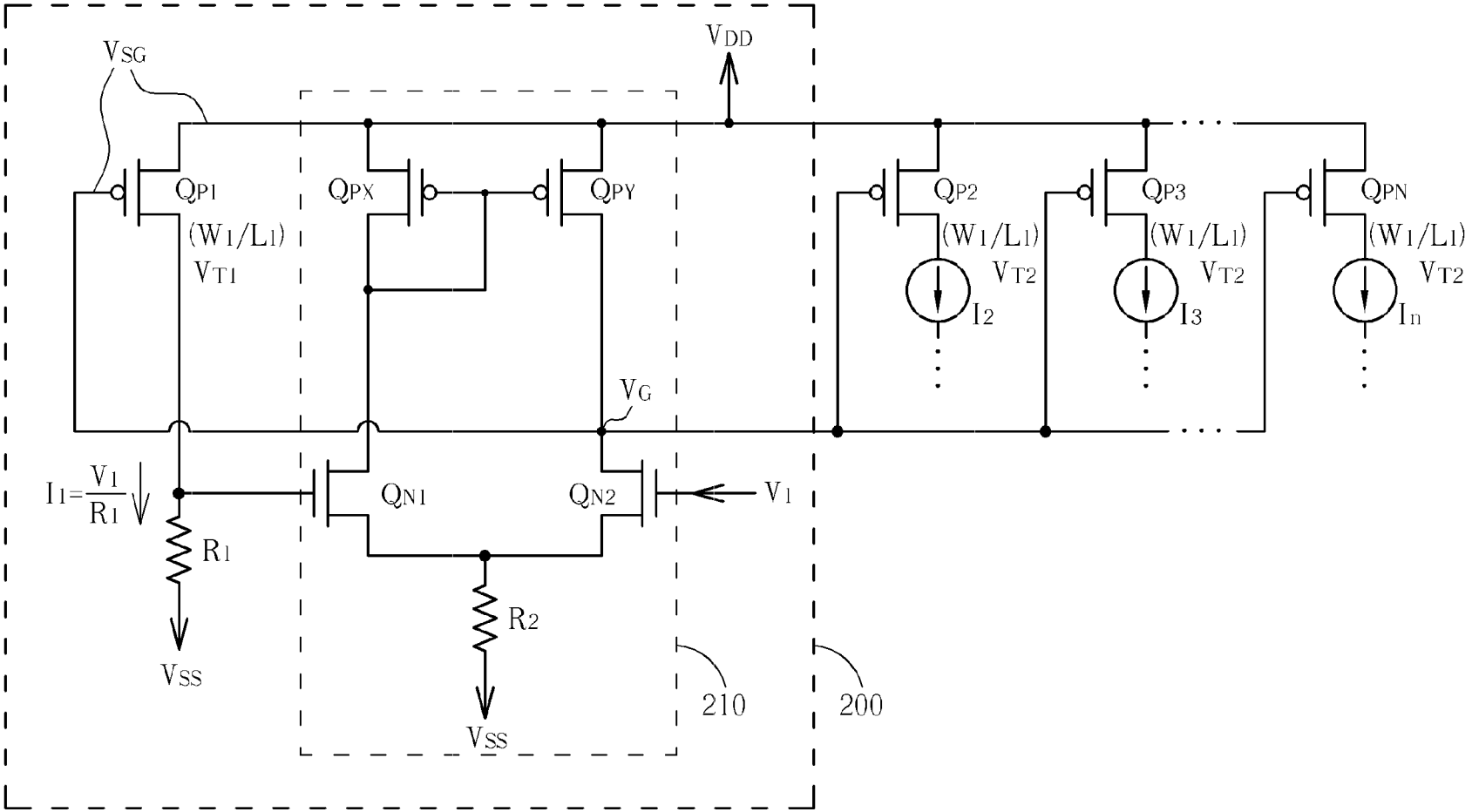
FIG. 2 is a diagram illustrating the current source 200 for reducing the affect of the threshold voltage according to the first embodiment of the present invention.

Please refer to FIG. 2. FIG. 2 is a diagram illustrating the current source 200 for reducing the affect of the threshold voltage according to the first embodiment of the present invention. The current source 200 comprises a feedback circuit 210, a PMOS transistor $Q_{P1}$, and a resistor $R_1$. The feedback circuit 210 comprises two PMOS transistors $Q_{PX}$ and $Q_{PY}$, two N-channel Metal Oxide Semiconductor (NMOS) transistors $Q_{N1}$ and $Q_{N2}$, and a resistor $R_2$. The current source 200 enables the PMOS transistors $Q_{P2}$, $Q_{P3}$ . . . $Q_{PN}$ to replicate the currents $I_2$, $I_3$ . . . $I_N$, in proportion to the magnitude of the reference current source $I_1$.

In the feedback circuit 210, the source (first end) of the PMOS transistor $Q_{PX}$ is coupled to the voltage source $V_{DD}$, the gate (control end) of the PMOS transistor $Q_{PX}$ is coupled to the drain (to ensure operation in the saturation region) of the PMOS transistor $Q_{PX}$, and the drain (second end) of the PMOS transistor $Q_{PX}$ is coupled to the drain (first end) of the NMOS transistor $Q_{N1}$. The source (first end) of the PMOS transistor $Q_{PY}$ is coupled to the voltage source $V_{DD}$, the gate (control end) of the PMOS transistor $Q_{PY}$ is coupled to the gate of the PMOS transistor $Q_{PX}$, and the drain (second end) of the PMOS transistor $Q_{PY}$ is coupled to the drain (first end) of the NMOS transistor $Q_{N2}$. The source (second end) of the NMOS transistor $Q_{N1}$ is coupled to the resistor $R_2$, the gate (control end) of the NMOS transistor $Q_{N1}$ is coupled to the resistor $R_1$, and the drain (first end) of the NMOS transistor $Q_{N1}$ is coupled to the drain of the PMOS transistor $Q_{PX}$. The source (second end) of the NMOS transistor $Q_{N2}$ is coupled to the resistor $R_2$, the gate (control end) of the NMOS transistor $Q_{N2}$ is utilized to receive a control voltage $V_1$, and the drain (first end) of the NMOS transistor $Q_{N2}$ is coupled to the drain of the PMOS transistor $Q_{PY}$. The resistor $R_2$ is coupled between the NMOS transistors $Q_{N1}$ and $Q_{N2}$, and the ground end ($V_{SS}$).

In the current source 200, the source (first end) of the PMOS transistor $Q_{P1}$ is coupled to the voltage source $V_{DD}$, the gate (control end) of the PMOS transistor $Q_{P1}$ is coupled to the drain (first end) of the NMOS transistor $Q_{N2}$ of the feedback circuit 210, and the drain (second end) of the PMOS transistor $Q_{P1}$ is coupled to the resistor $R_1$. The resistor $R_1$ is coupled between the drain of the PMOS transistor $Q_{P1}$, the gate (control end) of the NMOS transistor $Q_{N1}$, and the ground end. In this way, the voltage across the resistor $R_1$ equals the control voltage $V_1$. Hence the magnitude of the reference current source $I_1$ is limited by the control voltage $V_1$ and the resistance of the resistor $R_1$ ($I_1=V_1/R_1$). Therefore, the feedback circuit 210 controls the magnitude of the voltage difference $V_{SG}$ according to the magnitude of the control voltage $V_G$ for stabilizing the reference current source $I_1$ at ($V_1/R_1$) with the negative feedback manner.

In the first embodiment of the present invention, the threshold voltage $V_{T1}$ of the PMOS transistor $Q_{P1}$ is designed to be significantly higher than the threshold voltage $V_{T2}$ of the PMOS transistors $Q_{P2}$~$Q_{PN}$. Hence, under the condition that the reference current source $I_1$ is fixed and the channel aspect ratio ($W_1/L_1$) of the PMOS transistors $Q_{P1}$~$Q_{PN}$ is fixed, the voltage $V_{SG}$ across the PMOS transistor $Q_{P1}$ is relatively larger than those of the PMOS transistors $Q_{P2}$~$Q_{PN}$ such that the replicated currents $I_2$~$I_N$ can be unaffected by the threshold voltage $V_{T2}$. More particularly, when the threshold voltage $V_{T1}$ equals to the threshold voltage $V_{T2}$, the voltage $V_{SG}$ across the PMOS transistor $Q_{P1}$ can not be raised (when the magnitude of the reference current source $I_1$ is fixed to ($V_1/R_1$), and the channel aspect ratio ($W_1/L_1$) of the PMOS transistors $Q_{P1}$~$Q_{PN}$ is also fixed), according to formula (1): $I_1=\frac{1}{2}\times K\times(W_1/L_1)\times(V_{SG}-V_{T1})^2$. Hence, the first embodiment of the present invention demonstrates that increasing the threshold voltage $V_{T1}$ increases the voltage difference $V_{SG}$ accordingly. In FIG. 2, as the voltage $V_G$ decreases, the voltage $V_{SG}$ across the PMOS transistors $Q_{P2}$~$Q_{PN}$ increases accordingly. Also, due to the threshold voltage $V_{T2}$ of the PMOS transistors $Q_{P2}$~$Q_{PN}$ is designed to be relatively smaller than the threshold voltage $V_{T1}$, the variance of the threshold voltage $V_{T2}$ has less impact on the raised voltage $V_{SG}$, consequently causing the replicated currents $I_2$~$I_N$ to be controlled within a desired range.

Figure 3:
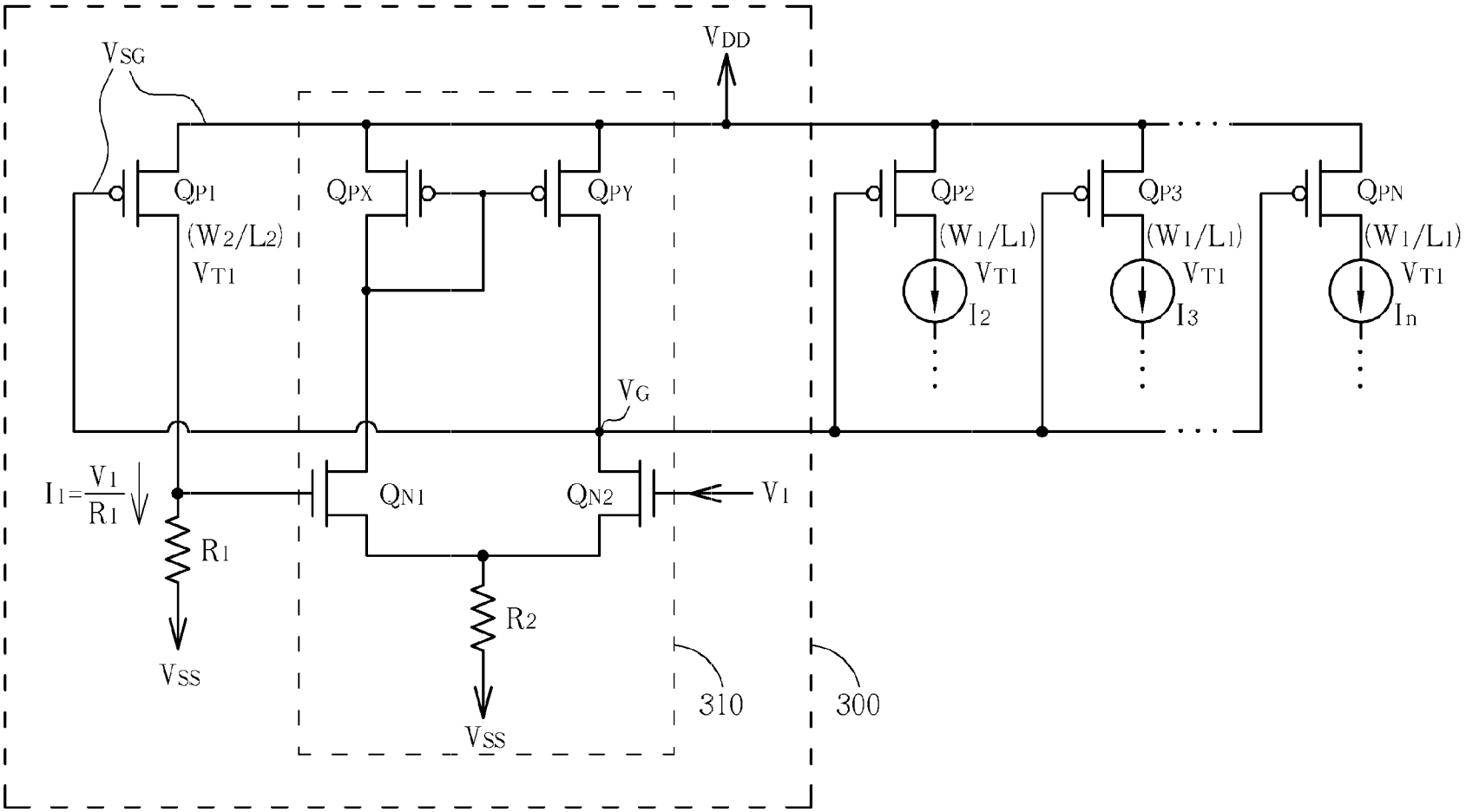
FIG. 3 is a diagram illustrating the current source 300 for reducing the impact of the threshold voltage according to the second embodiment of the present invention.

Please refer to FIG. 3. FIG. 3 is a diagram illustrating the current source 300 for reducing the impact of the threshold voltage according to the second embodiment of the present invention. The current source 300 comprises a feedback circuit 310, a PMOS transistor $Q_{P1}$, and a resistor $R_1$. The feedback circuit 310 comprises two PMOS transistors $Q_{PX}$ and $Q_{PY}$, two NMOS transistors $Q_{N1}$ and $Q_{N2}$, and a resistor $R_2$. The current source 300 enables the PMOS transistors $Q_{P2}$, $Q_{P3}$ . . . $Q_{PN}$ to replicate currents $I_2$, $I_3$ . . . $I_N$, in proportion to the magnitude of the reference current source $I_1$.

Differed from the first embodiment, in the second embodiment of the present invention, the threshold voltages of the PMOS transistors $Q_{P1}$~$Q_{PN}$ are designed to be as the same as the threshold voltage $V_{T1}$, and the channel aspect ratio ($W_2/L_2$) of the PMOS transistor $Q_{P1}$ is designed to be significantly lowered than the channel aspect ratios of the PMOS transistor $Q_{P2}$~$Q_{PN}$. Hence, under the condition that the magnitude of the reference current source $I_1$ is fixed and the channel aspect ratio ($W_2/L_2$) of the PMOS transistor $Q_{P1}$ is significantly lower than the channel aspect ratio ($W_1/L_1$) of the PMOS transistors $Q_{P2}$~$Q_{PN}$, the voltage $V_{SG}$ across the PMOS transistor $Q_{P1}$ can be raised such that the replicated currents $I_2$~$I_N$ can be unaffected by the threshold voltage $V_{T1}$. More particularly, when the channel aspect ratio ($W_2/L_2$) equals to the channel aspect ratio ($W_1/L_1$), the voltage $V_{SG}$ across the PMOS transistor $Q_{P1}$ cannot be raised (when the magnitude of the reference current source $I_1$ is fixed to ($V_1/R_1$) and the channel aspect ratio ($W_1/L_1$) of the PMOS transistors $Q_{P1}$~$Q_{PN}$ is also fixed), according to formula (1): $I_1=\frac{1}{2}\times K\times(W_1/L_1)\times(V_{SG}-V_{T1})^2$. When the channel aspect ratio is reduced to ($W_2/L_2$), the voltage $V_{SG}$ across the PMOS transistor $Q_{P1}$ can be raised to keep the reference current source $I_1$ to be fixed to ($V_1/R_1$), according to formula (1): $I_1=\frac{1}{2}\times K\times(W_2/L_2)\times(V_{SG}-V_{T1})^2$. Hence, the second embodiment of the present invention demonstrates that decreasing the channel aspect ratio of the PMOS transistor $Q_{P1}$ increases the voltage difference $V_{SG}$. As shown in FIG. 3, as the voltage difference $V_{SG}$ decreases, the voltage $V_{SG}$ across the PMOS transistors $Q_{P2}$~$Q_{PN}$ increases and the variance of the threshold voltage $V_{T1}$ of the PMOS transistors $Q_{P2}$~$Q_{PN}$ has less impact on the raised voltage $V_{SG}$, consequently causing the replicated currents $I_2$~$I_N$ to be controlled within a desired range.

In addition, there are two ways to lower the channel aspect ratio of the PMOS transistor $Q_{P1}$; one way is to increase the channel length of the PMOS transistor $Q_{P1}$, causing the channel aspect ratio of the PMOS transistor $Q_{P1}$ to decrease accordingly; the other way is to decrease the channel width of the PMOS transistor $Q_{P1}$, causing the channel aspect ratio to decrease accordingly.

Figure 4:
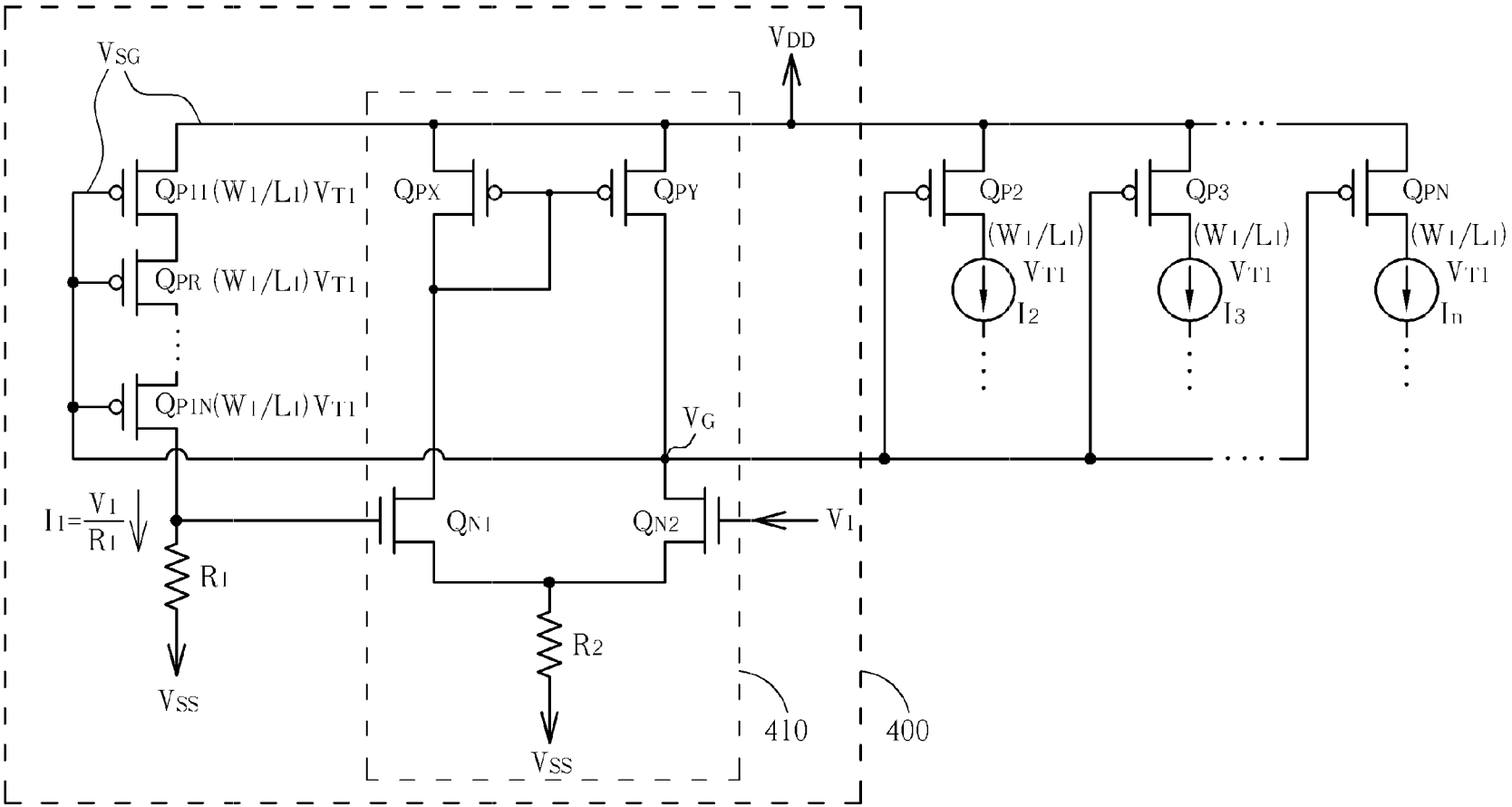
FIG. 4 is a diagram illustrating the current source 400 for reducing the impact of the threshold voltage according to the third embodiment of the present invention.

Please refer to FIG. 4. FIG. 4 is a diagram illustrating the current source 400 for reducing the impact of the threshold voltage according to the third embodiment of the present invention. The current source 400 comprises a feedback circuit 410, N PMOS transistors $Q_{P11}$~$Q_{P1N}$, and a resistor $R_1$. The feedback circuit 410 comprises two PMOS transistors $Q_{PX}$ and $Q_{PY}$, two NMOS transistors $Q_{N1}$ and $Q_{N2}$, and a resistor $R_2$. The current source 400 enables the PMOS transistors $Q_{P2}$, $Q_{P3}$ . . . $Q_{PN}$ to replicate currents $I_2$, $I_3$ . . . $I_N$, in proportion to the magnitude of the reference current source $I_1$.

In the current source 400, the PMOS transistor $Q_{P1}$ of the first embodiment of FIG. 2 is replaced by N PMOS transistors $Q_{P11}$~$Q_{P1N}$. In the current source 400, the source (first end) of the PMOS transistor $Q_{P11}$ is coupled to the voltage source $V_{DD}$, the gate (control end) of the PMOS transistor $Q_{P11}$ is coupled to the drain (first end) of the NMOS transistor $Q_{N2}$ of the feedback circuit 410, and the drain (second end) of the PMOS transistor $Q_{P11}$ is coupled to the source (first end) of the PMOS transistor $Q_{P12}$; the source (first end) of the PMOS transistor $Q_{P12}$ is coupled to the drain of the of the PMOS transistor $Q_{P11}$, the gate (control end) of the PMOS transistor $Q_{P12}$ is coupled to the drain (first end) of the NMOS transistor $Q_{N2}$ of the feedback circuit 410, and the drain (second end) of the PMOS transistor $Q_{P12}$ is coupled to the source (first end) of the PMOS transistor $Q_{P13}$ . . . , and so on; the source (first end) of the PMOS transistor $Q_{P1N}$ is coupled to the drain of the PMOS transistor $Q_{P1(N-1)}$, the gate (control end) of the PMOS transistor $Q_{P1N}$ is coupled to the drain (first end) of the NMOS transistor $Q_{N2}$ of the feedback circuit 410, and the drain (second end) of the PMOS transistor $Q_{P1N}$ is coupled to the resistor $R_1$. The resistor $R_1$ is couple between the drain of the PMOS transistor $Q_{P1N}$, the gate (control end) of the NMOS transistor $Q_{N1}$, and the ground end. Hence, the voltage across the resistor $R_1$ also equals the control voltage $V_1$. Hence, the magnitude of the reference current source $I_1$ is limited to $(V_1/R_1)$. Therefore, the feedback circuit 410 controls the magnitude of the voltage difference $V_{SG}$ according to the magnitude of the control voltage $V_G$ for stabilizing the reference current source $I_1$ at $(V_1/R_1)$ with the negative feedback manner.

In the third embodiment of the present invention, the threshold voltage of the PMOS transistor $Q_{P11}$~$Q_{P1N}$ and $Q_{P2}$~$Q_{PN}$ are designed to have the same as the threshold voltage $V_{T1}$ and the same channel aspect ratio $(W_1/L_1)$. Since the PMOS transistors $Q_{P11}$~$Q_{P1N}$ are connected in series, the serial-connected PMOS transistors $Q_{P11}$~$Q_{P1N}$ can be equivalent to a single PMOS transistor, with an effective channel length of a multiple of N. In other words, in the equivalent MOS transistor, the channel aspect ratio changes to a multiple of 1/N (which implies decreasing to a multiple of 1/N). Hence, effectively speaking, the third embodiment of the present invention is similar to the second embodiment of the present invention in terms of lowering the channel aspect ratio to increase the voltage difference $V_{SG}$. In other words, under the condition that the reference current source $I_1$ is kept constant and the channel aspect ratio $(W_1/NL_1)$ of the PMOS transistors $Q_{P11}$~$Q_{P1N}$ is significantly lower than the channel aspect ratios $(W_1/L_1)$ of the PMOS transistors $Q_{P2}$~$Q_{PN}$, the voltage $V_{SG}$ across the PMOS transistors $Q_{P11}$~$Q_{PN}$ can be raised, consequently avoiding the replicated currents $I_2$~$I_N$ being affected by the threshold voltage $V_{T1}$ and being controlled within a desired range.

Figure 5:
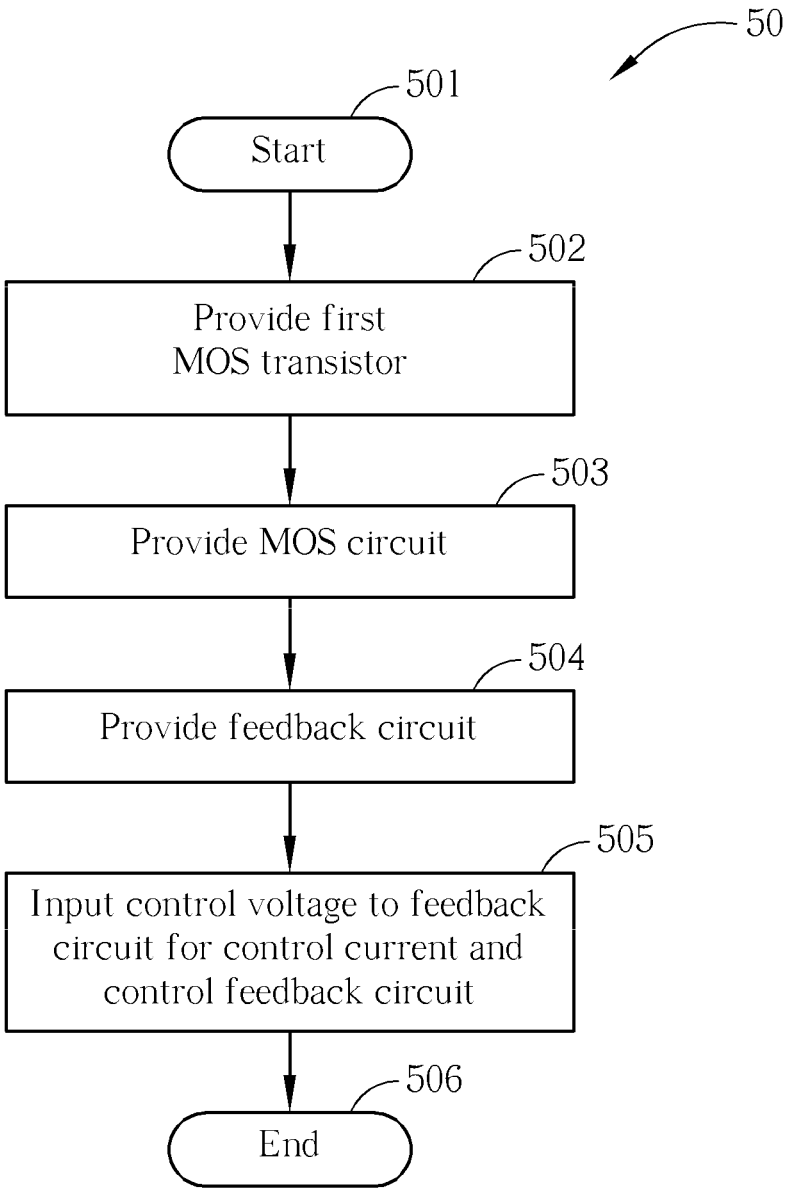
FIG. 5 is a flowchart illustrating a method 500 of generating the current with immunity to the variation of the threshold voltage of the present invention.

Please refer to FIG. 5. FIG. 5 is a flowchart illustrating a method 500 of generating the current with immunity to the variation of the threshold voltage of the present invention. The steps of the method are explained below:

Step 510: Start;

Step 502: Provide a first MOS transistor to be coupled to a voltage source;

Step 503: Provide a MOS circuit to be coupled to the first MOS transistor and the voltage source;

Step 504: Provide a feedback circuit to be coupled to the voltage source, wherein the feedback circuit comprises a feedback end coupled between the MOS circuit and the first MOS transistor;

Step 505: Input a control voltage to the feedback circuit for control a current with a predetermined magnitude passing through the MOS circuit, as well as control a voltage of the feedback end;

Step 506: End.

In step 503, the MOS transistor comprises a sixth MOS transistor. The channel aspect ratio of the sixth MOS transistor can be adjusted to be lower than the channel aspect ratio of the first MOS transistor, or, the threshold voltage of the sixth MOS transistor can be adjusted to be higher than the threshold voltage of the first MOS transistor.

In step 503, the MOS circuit can also be realized with a plurality of MOS transistors connected in series. The channel aspect ratio of every MOS transistor of the plurality of MOS transistors connected in series can be adjusted to approximately equal to the channel aspect ratio of the first MOS transistor.

To sum up, the current source and the method for generating the current of the present invention can effectively resist the impact of the variation of the threshold voltage during processing to the current stability, providing great convenience.

Those skilled in the art will readily observe that numerous modifications and alterations of the device and method may be made while retaining the teachings of the invention.

What is claimed is:

1. A current source, for driving a Metal Oxide Semiconductor (MOS) circuit to generate a predetermined current, the current source comprising:

a feedback circuit, comprising:

a second MOS transistor, comprising:

a first end, coupled to a voltage source;

a control end; and a second end, coupled to the control end of the second MOS transistor;

a third MOS transistor, comprising:

a first end, coupled to the voltage source;

a control end, coupled to the control end of the second MOS transistor; and a second end;

a fourth MOS transistor, comprising:

a first end, coupled to the second end of the third MOS transistor, for outputting a feedback voltage;

a control end, for receiving a control voltage; and a second end; and a fifth MOS transistor, comprising:

a first end, coupled to the second end of the second MOS transistor;

a control end, for outputting an output voltage, wherein the output voltage is equal to the control voltage; and a second end;

a first resistor, coupled between the ground end and the control end of the fifth MOS transistor; and the MOS circuit, comprising a plurality of MOS transistors connected in series;

a first end of a sixth MOS transistor of the plurality of MOS transistors connected in series being coupled to the voltage source;

a control end of each of the plurality of MOS transistors being directly coupled to the first end of the fourth MOS transistor, and controlled by the feedback voltage; and a second end of a seventh MOS transistor of the plurality of MOS transistors connected in series being coupled to the control end of the fifth MOS transistor;

wherein the output voltage of the control end of the fifth MOS transistor is not influenced by series source/drain voltages of the plurality of MOS transistors, and a decrease of the feedback voltage is dependent on an equivalent channel length of the plurality of MOS transistors, not dependent on a process of the plurality of MOS transistors or a threshold voltage of the sixth MOS transistor.

2. The current source of claim 1, wherein threshold voltage of the sixth MOS transistor is higher than threshold voltage of the first MOS transistor.

3. The current source of claim 1, wherein the first, second, third and sixth MOS transistors are P-type Metal Oxide Semiconductor (PMOS) transistors.

4. The current source of claim 1, wherein channel aspect ratio of the sixth MOS transistor is lower than channel aspect ratio of the first MOS transistor.

5. The current source of claim 1, wherein the fourth and fifth MOS transistors are N-type Metal Oxide Semiconductor (NMOS) transistors.

6. The current source of claim 1, further comprising a resistor, coupled between the second end of the fourth MOS transistor, the second end of the fifth MOS transistor, and the ground end.

7. The current source of claim 1, wherein the channel aspect ratio of each MOS transistor of the plurality of MOS transistors connected in series is approximately equal to the channel aspect ratio of the first MOS transistor.

8. The current source of claim 1, wherein threshold voltage of each MOS transistor of the plurality of MOS transistors connected in series is approximately equal to the threshold voltage of the first MOS transistor.

9. A current source, comprising:

a feedback circuit, comprising:

a first end, coupled to a voltage source;

a control end, for receiving a control voltage;

an output end, for outputting an output voltage, wherein the output voltage is equal to the control voltage; and a feedback end for outputting a feedback voltage;

a first resistor, coupled to a ground end and the output end of the feedback circuit; and a MOS circuit, comprising a plurality of MOS transistors connected in series for generating a predetermined current;

a first end of a sixth MOS transistor of the plurality of MOS transistors connected in series being coupled to the voltage source;

a control end of each of the plurality of MOS transistors being directly coupled to the feedback end of the feedback circuit, and controlled by the feedback voltage; and a second end of a seventh MOS transistor of the plurality of MOS transistors connected in series being coupled to the output end of the feedback circuit;

wherein the output voltage of the control end of the fifth MOS transistor is not influenced by series source/drain voltages of the plurality of MOS transistors, and a decrease of the feedback voltage is dependent on an equivalent channel length of the plurality of MOS transistors, not dependent on a process of the plurality of MOS transistors or a threshold voltage of the sixth MOS transistor.

10. The current source of claim 9, wherein threshold voltage of the sixth MOS transistor is higher than threshold voltage of the first MOS transistor.

11. The current source of claim 9, wherein aspect ratio of the sixth MOS transistor is lower than aspect ratio of the first MOS transistor.

12. The current source of claim 9, further comprising a resistor coupled between a second end of the feedback circuit and the ground end.

13. The current source of claim 9, wherein the channel aspect ratio of each MOS transistor of the plurality of MOS transistors connected in series is approximately equal to the channel aspect ratio of the first MOS transistor.

14. The current source of claim 9, wherein threshold voltage of each MOS transistor of the plurality of MOS transistors connected in series is approximately equal to the threshold voltage of the first MOS transistor.

15. A method for generating current with immunity for variation of threshold voltage, the method comprising:

providing a first MOS transistor for a first end of the first MOS transistor to be coupled to a voltage source;

providing a MOS transistor circuit to be connected to the first MOS transistor in series, the MOS transistor circuit comprising a plurality of MOS transistors connected in series;

providing a feedback circuit to be coupled to the voltage source, the feedback circuit comprising a feedback end directly coupled to control ends of the plurality of MOS transistors of the MOS transistor circuit and a control end of the first MOS transistor; and inputting a control voltage to the feedback circuit for generating an output voltage of the feedback circuit to control a current with a predetermined magnitude passing through the MOS transistor circuit, as well as controlling a voltage of the feedback end, wherein the control ends of the plurality of the MOS transistors of the MOS transistor circuit and the control end of the first MOS transistor are controlled by the voltage of the feedback end;

wherein the output voltage of the feedback circuit is not influenced by series source/drain voltages of the plurality of MOS transistors and the first MOS transistor, and a decrease of the voltage of the feedback end is dependent on an equivalent channel length of the plurality of MOS transistors and the first MOS transistor, not dependent on a process of the plurality of MOS transistors or a threshold voltage of the first MOS transistor.

16. The method of claim 15, wherein the MOS transistor circuit comprises a sixth MOS transistor, and the method further comprises:

adjusting channel aspect ratio of the sixth MOS transistor to be lower than channel aspect ratio of the first MOS transistor.

17. The method of claim 15, wherein the MOS transistor circuit comprises a sixth MOS transistor, and the method further comprises:

adjusting threshold voltage of the sixth MOS transistor to be higher than threshold voltage of the first MOS transistor.

18. The method of claim 15, further comprising:

adjusting channel aspect ratio of every MOS transistor of the plurality of MOS transistors connected in series to approximately equal to channel aspect ratio of the first MOS transistor.

* * * * *